US007988429B2

(12) United States Patent
Okumura et al.

(10) Patent No.: US 7,988,429 B2
(45) Date of Patent: Aug. 2, 2011

(54) CHEMICAL LIQUID SUPPLY SYSTEM

(75) Inventors: Katsuya Okumura, Tokyo (JP); Shigenobu Itoh, Komaki (JP); Tetsuya Toyoda, Komaki (JP); Kazuhiro Sugata, Komaki (JP)

(73) Assignees: Octec Inc., Tokyo (JP); Tokyo Electron Limited, Tokyo (JP)

( * ) Notice: Subject to any disclaimer, the term of this patent is extended or adjusted under 35 U.S.C. 154(b) by 1023 days.

(21) Appl. No.: 11/659,727

(22) PCT Filed: Jul. 29, 2005

(86) PCT No.: PCT/JP2005/013919

§ 371 (c)(1),
(2), (4) Date: Feb. 8, 2007

(87) PCT Pub. No.: WO2006/016486

PCT Pub. Date: Feb. 16, 2006

(65) Prior Publication Data

US 2007/0267065 A1 Nov. 22, 2007

(30) Foreign Application Priority Data

Aug. 9, 2004 (JP) ..... 2004-232071

(51) Int. Cl.
*B65D 37/00* (2006.01)
*B65D 83/00* (2006.01)

(52) U.S. Cl. ..... 417/395; 222/207; 222/214; 222/399

(58) Field of Classification Search ..... 417/53, 417/395; 222/52, 63, 71, 334, 207, 214, 222/399

See application file for complete search history.

(56) References Cited

U.S. PATENT DOCUMENTS 5,134,962 A * 8/1992 Amada et al. ..... 118/688
6,062,442 A * 5/2000 Yang et al. ..... 222/571
6,206,240 B1 * 3/2001 Osgar et al. ..... 222/39
6,460,404 B1 * 10/2002 Chan et al. ..... 73/40

(Continued)

FOREIGN PATENT DOCUMENTS

JP A 03-114565 5/1991

(Continued)

OTHER PUBLICATIONS

Japanese Office Action mailed on Mar. 16, 2010 for Japanese Application No. 2004-232071 w/English translation.

*Primary Examiner* — Charles G Freay
*Assistant Examiner* — Patrick Hamo
(74) *Attorney, Agent, or Firm* — Smith, Gambrell & Russell, LLP

(57) ABSTRACT

A chemical liquid supply system that prevents the generation of heat during operation in a pump and allows downsizing the discharge pump for instilling a chemical liquid from a tip nozzle. Compressed air is supplied to an upper space of a resist bottle and the chemical liquid is conferred positive pressure and sent out to a pump chamber of a discharge pump, thereby the pump chamber is filled with a resist liquid. This eliminates the need of a conventional construction where a spring or others are used to drive a flexible membrane of the discharge pump to the operation chamber side to take in the resist liquid. As a result, no electric motor is used, so there is obviously no risk of heat damage to a semiconductor wafer and the discharge pump itself can be further downsized.

10 Claims, 2 Drawing Sheets

U.S. PATENT DOCUMENTS

| | | | | |
|---|---|---|---|---|
| 6,550,250 | B2 | 4/2003 | Mikkelsen et al. | |
| 7,747,344 | B2 * | 6/2010 | O'Dougherty et al. | 700/231 |

FOREIGN PATENT DOCUMENTS

| | | |
|---|---|---|
| JP | A 07-324680 | 12/1995 |
| JP | A 08-083759 | 3/1996 |
| JP | A 10-061558 | 3/1998 |
| JP | A 11-343978 | 12/1999 |
| JP | A 2002-327617 | 11/2002 |
| JP | A 2003-049778 | 2/2003 |

* cited by examiner

CHEMICAL LIQUID SUPPLY SYSTEM

TECHNICAL FIELD OF THE INVENTION

The invention relates to a chemical liquid supply system for instilling a discharged chemical liquid in which the chemical liquid is taken in and then discharged with a pump. Specifically, the invention relates to a chemical liquid supply system suited for use in a process that uses a chemical liquid for a semiconductor manufacturing device, such as the coating process of a chemical liquid such as photoresist.

BACKGROUND ART

In processes that use a chemical liquid for a semiconductor manufacturing device, a chemical liquid supply system such as that in Patent Reference 1, for example, has been disclosed for coating a specified volume of a chemical liquid such as photoresist on semiconductor wafers. In this chemical liquid supply system, a flexible tube is present in a chemical liquid passage within a pump, and an elastically deformable bellows is provided on the outside of the flexible tube. A small bellows member and a large bellows member of differing internal diameters are provided in an aligned manner in the axial direction of the flexible tube in the bellows, and an incompressible medium is inserted in the space between the bellows and the flexible tube. Moreover, a motor actuator incorporated in a unitary manner with the pump causes the small bellows member to expand and the large bellows member to contract, decreases the volume of the flexible tube via the incompressible medium, and discharges the chemical liquid. Conversely, the motor actuator causes the small bellows member to contract and the large bellows member to expand, increases the volume of the flexible tube via the incompressible medium, and takes in the chemical liquid.

The motor actuator, however, was expensive and made the configuration of the system complex. Additionally, the amount of heat generated during operation increased, and this heat posed the risk of damaging semiconductor wafers positioned near the pump for receiving the chemical liquid supplied from the pump.

A technology for resolving the above-mentioned problem is disclosed in Patent Reference 2, for example. In this chemical liquid supply system, a diaphragm is used that divides a pump chamber for filling the chemical liquid into the pump and a pressurization chamber (operating chamber). In order to decrease the volume of the pump chamber so that the chemical liquid is discharged, air is supplied under pressure from a regulator to the pressurization chamber of the pump, and the diaphragm is deformed toward the side of the pump chamber. Conversely, in order to increase the volume of the pump chamber so that the chemical liquid is taken in, the air pressure within the pressurization chamber of the pump is decreased with a regulator, and the diaphragm is deformed toward the side opposite the pump chamber. In this situation, a decrease in the air pressure alone cannot adequately bring about an amount of deformation (amount of operation) of the diaphragm toward the side opposite the pump chamber. Therefore, a spring is provided in the pump, and the diaphragm is impelled toward the side opposite the pump by the spring so that the diaphragm is deformed toward the side opposite the pump chamber.

No motor that generates a large volume of heat is used in this chemical liquid supply system, so the risk of heat-related damage to semiconductor wafers is eliminated. A spring for deforming the diaphragm toward the side opposite the pump chamber, however, is provided in the pump, which presents a problem when the pump is to be downsized.

Patent Reference 1: Japanese Patent Application Publication H10-61558

Patent Reference 2: Japanese Patent Application Publication H11-343978

DISCLOSURE OF THE INVENTION

A primary object of the invention is to provide a chemical liquid supply system that prevents the generation of heat during operation in a discharge pump for instilling a chemical liquid from a tip nozzle and allows downsizing the discharge pump by eliminating a means for impelling that activates a variable volume member toward the side opposite a pump chamber.

A chemical liquid supply system according to the present teaching is configured as described here. The system comprises:

a discharge pump in which a pump chamber filled with the chemical liquid and an operating chamber are divided by a variable volume member, the variable volume member is driven by supplying an operating gas into the operating chamber to decrease the volume of the pump chamber, and the chemical liquid is discharged according to this change of volume;

an opening-closing-type discharge-side closure valve provided between the discharge pump and a tip nozzle;

a means for switching that switches to either a first state in which the operating gas of a set pressure is supplied to the operating chamber or a second state in which the operating chamber is opened to the atmosphere;

a means for chemical liquid supply that brings the chemical liquid to positive pressure and supplies the chemical liquid to the discharge pump;

an opening-closing-type supply-side closure valve provided between the discharge pump and the means for chemical liquid supply; and a means for controlling that controls both of the closure valves and the means for switching so that the supply-side closure valve is switched to the closed position, the discharge-side closure valve is switched to the open position, and the means for switching is switched to the first state when the chemical liquid is to be discharged from the discharge pump; the supply-side closure valve is switched to the open position, the discharge-side closure valve is switched to the closed position, and the means for switching is switched to the second state when the chemical liquid is to be filled into the discharge pump; and the supply of the chemical liquid is begun by the means for chemical liquid supply.

In this configuration of the chemical liquid supply system, a chemical liquid placed under positive pressure by a means for chemical liquid supply is supplied to a pump chamber of a discharge pump, and the chemical liquid is filled into the pump chamber. This therefore eliminates the conventional need to use a spring or other items to drive a variable volume member of the discharge pump toward the side on which the volume of the pump chamber expands to cause the chemical liquid to be taken in during chemical liquid filling. No motor is used in this configuration, so there is obviously no risk of heat damage to the item onto which the chemical liquid is to be instilled, such as a semiconductor wafer, and additionally, the discharge pump for discharging the chemical liquid and instilling the chemical liquid from the tip nozzle can be further downsized.

Downsizing the discharge pump confers the following benefits. First, downsizing the discharge pump allows the space for installing the discharge pump to be decreased even more than has been done to the present. In the case of semiconductor manufacturing equipment, for example, the discharge pump is placed near the semiconductor wafer to improve precision in the amount of the chemical liquid discharged. The maximum level of cleanliness is required within this installation space where the semiconductor wafer is set. In consideration of the cost of bringing about clean conditions, such spaces should be made as small as possible, and this configuration greatly contributes to cost reduction in that the installation space can be made smaller. Moreover, the downsizing of the discharge pump allows the discharge pump to be placed more closely to the tip nozzle than is presently possible. As such, when a chemical liquid discharge part that comprises the tip nozzle and the discharge pump as a pair is provided in plurality, the differences in tubing length from the discharge pump to the tip nozzle and head in each respective chemical liquid discharge part can be made smaller. Therefore, making the control values of each chemical liquid discharge part uniform becomes easier, and control is simplified.

Driving the variable volume member toward the side of the operating chamber by evacuating the operating chamber to expand the volume of the pump chamber and thereby to cause the taking in of the chemical liquid into the pump itself is a possible means for chemical liquid filling. Such a configuration would eliminate the need for incorporating a spring or other item into the pump. Evacuation, however, creates an artificially harsh condition, so a variety of problems are created, including the need for a construction able to tolerate this condition. The above configuration, in which the chemical liquid is supplied to the discharge pump simply by providing another means for chemical liquid supply is very beneficial in that the need for a spring or other item is eliminated and the discharge pump can be downsized according to this very simple configuration.

If a filter is to be provided between the discharge pump and a chemical liquid supply container, causing the chemical liquid to be taken in by evacuating the operating chamber subjects the chemical liquid in the pump chamber to negative pressure. As such, filter pressure loss creates a pressure differential around the filter, generating bubbles that damage the item to be instilled. With regard to this point, the above configuration prevents the generation of bubbles when the chemical liquid passes through the filter because the chemical liquid, with positive pressure, is supplied from the means for chemical liquid supply to the discharge pump.

As a preferred example of the chemical liquid supply system, the opposite end of a chemical liquid supply tubing having one end connected to the discharge pump is disposed within the chemical liquid of the chemical liquid supply container, and the means for chemical liquid supply is given a configuration such that a pressurized gas of a set pressure is supplied into a space above the chemical liquid in the hermetically sealed chemical liquid supply container by a chemical liquid supply command from the means for controlling to confer positive pressure to and send out the chemical liquid.

According to this configuration, the pressurized gas of a set pressure is supplied to the space above the chemical liquid in the chemical liquid supply container by a command from the means for controlling to start chemical liquid supply, and the chemical liquid is thereby sent from the chemical liquid supply container to the discharge pump. At this time the pressure in the space above the chemical liquid is equal to the supply pressure of the chemical liquid. The supply pressure is positive pressure relative to atmospheric pressure. In this configuration, the pressure in the space above the chemical liquid is brought to the set pressure almost simultaneously with the supply of the pressurized gas, so this supply pressure can be brought to the set pressure with an excellent response to the chemical liquid supply start command. Supplying the pressurized gas of the set pressure to the space above the chemical liquid allows the supply pressure to be maintained at a constant value, so control of chemical liquid supply is simplified. As the chemical liquid supply command is not sent from the means for controlling when the chemical liquid supply system is not operating, the space above the chemical liquid during the exchange of chemical liquid supply containers is brought to an unpressurized state, such as equilibration with atmospheric pressure, so the pressurized gas beneficially does not unintentionally leak from the chemical liquid supply container.

As another preferred example of the chemical liquid supply system, the opposite end of the chemical liquid supply tubing having one end connected to the discharge pump is disposed within the chemical liquid of the chemical liquid supply container, and the means for chemical liquid supply is given a configuration such that the pressurized gas of a set pressure is continually supplied into the space above the chemical liquid in the hermetically sealed chemical liquid supply container to confer positive pressure to and send out the chemical liquid.

According to this configuration, the pressurized gas of a set pressure is continually supplied to the space above the chemical liquid in the chemical liquid supply container, and the chemical liquid is thereby sent from the chemical liquid supply container to the discharge pump. At this time the pressure in the space above the chemical liquid is equal to the supply pressure of the chemical liquid. The supply pressure is positive pressure relative to atmospheric pressure. In this configuration, the pressure in the space above the chemical liquid is brought to the set pressure almost simultaneously with the supply of the pressurized gas, so this supply pressure can be brought to the set pressure with an excellent response to the chemical liquid supply start command. Supplying the pressurized gas of the set pressure to the space above the chemical liquid allows the supply pressure to be maintained at a constant value, so control of chemical liquid supply is simplified. Continually supplying the pressurized gas to the space above the chemical liquid in the chemical liquid supply container reduces the control load by the means for controlling in comparison to the previous preferred example. But in this case, a manual valve or other item is preferably connected to allow the space in the container to be brought to atmospheric pressure when the chemical liquid supply container is to be exchanged.

In addition, a filter is preferably provided between the discharge pump and the chemical liquid supply container.

Even when the filter is provided between the discharge pump and the chemical liquid supply container, the chemical liquid, with positive pressure, is supplied to the discharge pump by the means for chemical liquid supply, so the generation of bubbles when the chemical liquid passes through the filter is prevented. Moreover, dust and other matter mixed in with the chemical liquid is removed before supply to the discharge pump when the chemical liquid is supplied by the means for chemical liquid supply. Thus, the chemical liquid can be purified around the discharge pump, and the installation space of the discharge pump can be made smaller.

REFERENCE SYMBOLS

11: discharge pump, 12: supply tubing as chemical liquid supply tubing, 13: supply-side valve as supply-side closure valve, 15: resist bottle as chemical liquid supply container, 17: first switching valve constituting the means for chemical liquid supply, 18: pressure control valve constituting the means for chemical liquid supply, 22: discharge-side closure valve, 26: second switching valve as means for switching, 29: controller as means for controlling.

PREFERRED EMBODIMENTS OF THE INVENTION

Figure 1:
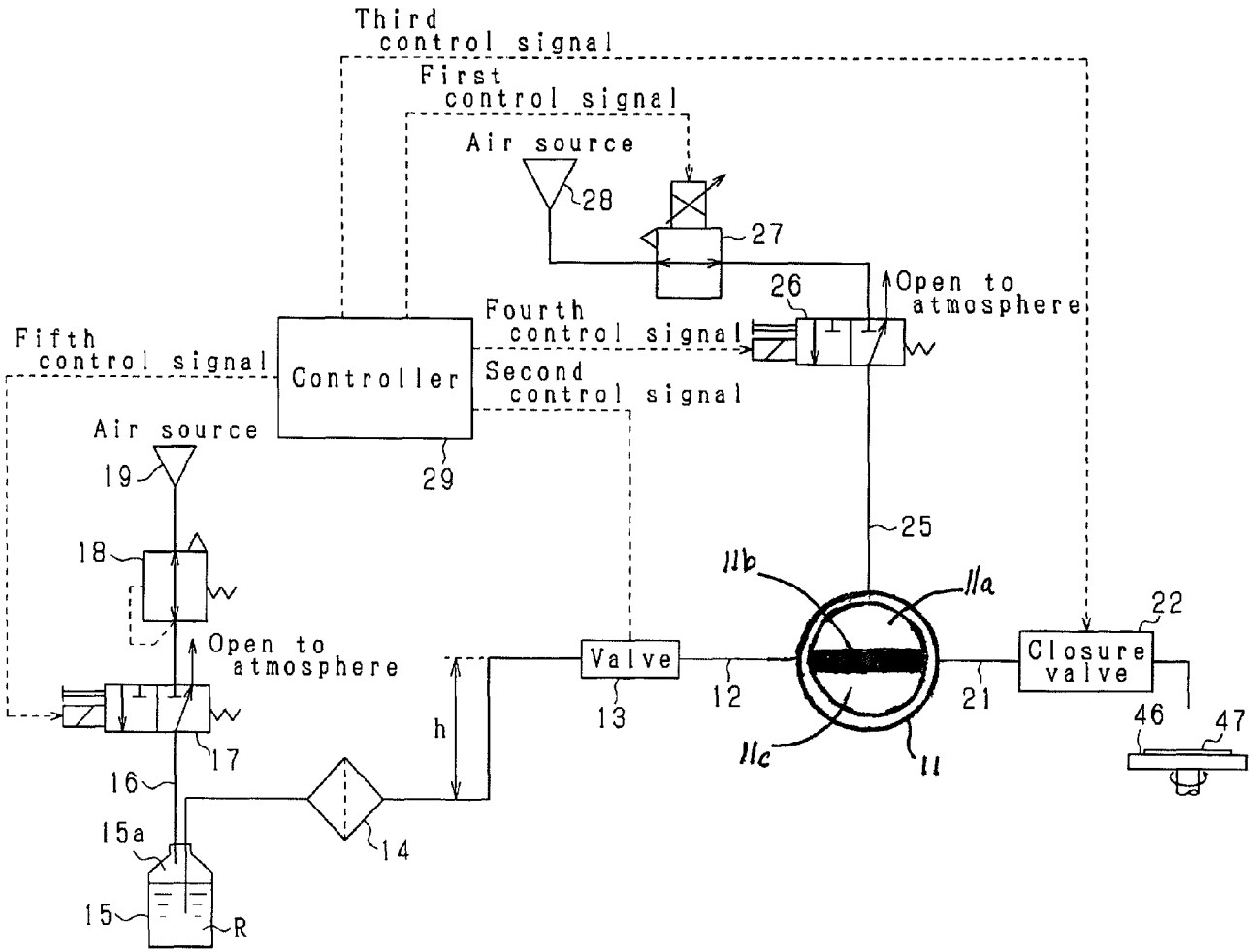
FIG. 1 is a circuit diagram illustrating the overall circuitry of an embodiment of the chemical liquid supply system.

Hereafter, a specific embodiment of the invention is discussed in reference to the drawings. In this embodiment, a chemical liquid supply system used in the manufacturing line of semiconductor equipment and other items is embodied and explained based on the circuit diagram in FIG. 1.

The chemical liquid supply system comprises a discharge pump 11 for discharging a chemical liquid. Although the inner construction of the discharge pump 11 is not shown in the drawings, a space is formed therein. The inner space is divided into an operating chamber 11*a* on which air pressure acts and a pump chamber 11*c* that is filled with the chemical liquid by a flexible membrane 11*b* such as a diaphragm that corresponds to the variable volume member. The air pressure in the operating chamber 11*a* is controlled in a state in which the volume of the pump chamber 11*c* expands to fill the chamber with liquid so that the flexible membrane 11*b* is deformed toward the pump chamber side 11*c* (the volume of the pump chamber 11*c* contracts) and the chemical liquid is discharged from the pump chamber 11*c*.

One end of a supply tubing 12 is connected to a supply port, not shown in the drawings, that is provided on the chemical liquid supply side of the discharge pump 11. Another end of the supply tubing 12 is guided into resist R as the chemical liquid of a resist bottle 15 via a supply-side valve 13 and a filter 14. The resist bottle 15 corresponds to the chemical liquid supply container. The supply-side valve 13 is an inexpensive air-operated valve capable of switching between an open position and a closed position and corresponds to the supply-side closure valve. Finally, the filter 14 removes dust and other matter when the resist R passes through the supply tubing 12.

One end of a pressurized tubing 16 is inserted in the resist bottle 15, and that end is positioned in the space above the resist R (upper-layer space) 15*a*. The upper-layer space 15*a* in the resist bottle 15 is hermetically sealed. A first switching valve 17 that is a two-position, three-port of electromagnetic switching valve is connected to the other end of the pressurized tubing 16. One of the remaining two ports of the first switching valve 17 is opened to the atmosphere, and the other is connected to an air source 19 via a pressure control valve 18. When an electromagnetic solenoid that the first switching valve 17 comprises is off, the space within the pressurized tubing 16 is opened to the atmosphere. When, on the other hand, the electromagnetic solenoid is on, the pressurized tubing 16 is communicated with the air source 19 via the pressure control valve 18. Air compressed by a compressor or other means is supplied from the air source 19, and the compressed air, after being brought to a set pressure by the pressure control valve 18, is supplied to the first switching valve 17. Therefore, turning the electromagnetic solenoid of the first switching valve 17 on causes the compressed air of a set pressure to be supplied by the pressure control valve 18 to the upper-layer space 15*a* in the resist bottle 15. The means for chemical liquid supply constituted by the first switching valve 17 and the pressure control valve 18.

One end of a discharge tubing 21 is connected to a discharge port, not shown in the drawings, that is provided on the chemical liquid discharge side of the discharge pump 11. The other end of the discharge tubing 21 serves as a tip nozzle. The tip nozzle is oriented downward and is positioned so that the resist R is instilled at the center position of a semiconductor wafer 47 placed on a rotary plate 46. Additionally, a discharge-side closure valve 22 is present midway through the discharge tubing 21, which extends to the tip nozzle. The discharge-side closure valve 22 is the air operated valve mentioned earlier.

Thus, the resist R in the resist bottle 15 is guided along the route extending to the tip nozzle of the discharge tubing 21 via the supply tubing 12, the pump chamber 11*c* inside the discharge pump 11, and the discharge tubing 21. The discharge tubing 21 is preferably made short to improve precision in the amount of the resist R discharged. Therefore, the discharge pump 11 and the discharge-side closure valve 22 are located in a position near the rotary plate 46 on which the semiconductor 47 is placed.

A supply and drainage port, not shown in the drawings, that is communicated to the operating chamber 11*a* is provided in the discharge pump 11, and an air tubing 25 is connected to the supply and drainage port. A second switching valve 26 that is a two-position, three-port electromagnetic switching valve is connected to the air tubing 25. The second switching valve 26 corresponds to the means for switching. One of the remaining two ports of the second switching valve 26 is opened to the atmosphere, and the other is connected to an air source 28 via an electropneumatic regulator 27. The inside of the air tubing 25 is opened to the atmosphere when the electromagnetic solenoid that the second switching valve 26 comprises is off, and the air tubing 25 is communicated with the air source 28 via the electropneumatic regulator 27 when the electromagnetic solenoid is on. Therefore, the operating chamber 11*a* is opened to the atmosphere when the electromagnetic solenoid of the second switching valve 26 is turned off. When the electromagnetic solenoid of the second switching valve 26 is turned on, on the other hand, compressed air of the set pressure is supplied via the electropneumatic regulator 27 to the operating chamber 11*a*.

The supply-side valve 13, the first switching valve 17, the second switching valve 26, the electropneumatic regulator 27, and the discharge-side closure valve 22 are connected to a controller 29 comprising a microcomputer or other device. The controller 29 corresponds to the means for controlling. Electromagnetic solenoids of the first switching valve 17 and the second switching valve 26 are turned on or off by signals from the controller 29. Moreover, the supply-side valve 13 and the discharge-side closure valve 22 are individually turned on or off by the controller 29 to bring each to an opened or closed state. Additionally, signals that set the pressure of the compressed air are sent from the controller 29 to the electropneumatic regulator 27.

Figure 2:
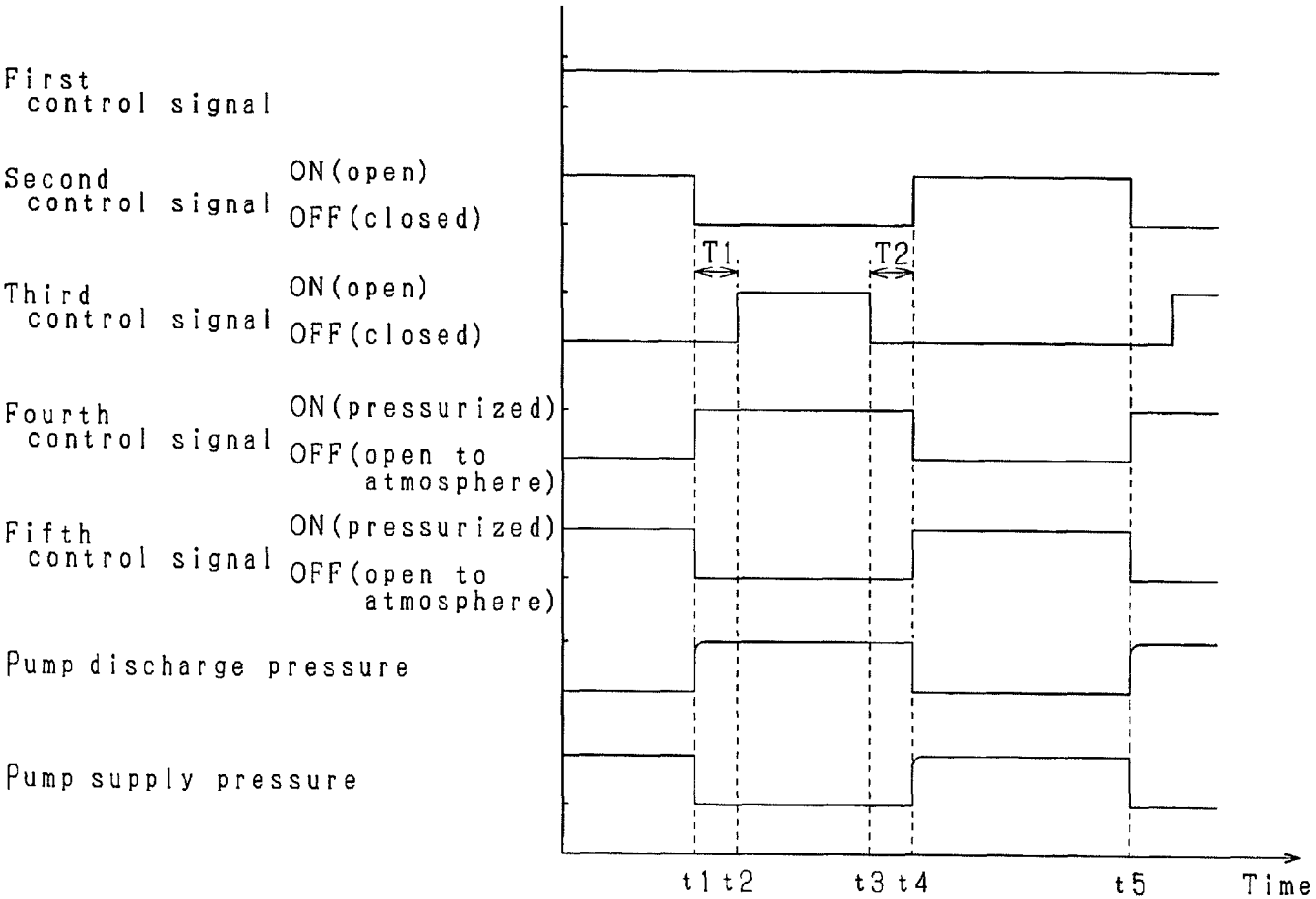
FIG. 2 is a time-chart showing the operating sequence of an embodiment of the chemical liquid supply system.

Next, the operating sequence of the chemical liquid supply system is described based on the time-chart shown in FIG. 2.

In FIG. 2, the compressed air of the air source 28 is brought to the pressure set by the electropneumatic regulator 27 through a first command signal from the controller 29, and the compressed air of the set pressure is supplied to the second switching valve 26. When a second control signal from the controller 29 is first brought to the off level at the timing of t1 in this state, the supply-side valve 13 is switched to the closed position. The supply tubing 12 is therefore closed at the position of the supply-side valve 13. Simultaneously, a fifth command signal from the controller 29 is brought to the off level at the timing of t1, and the first switching valve 17 is switched to the closed position. Therefore, the pressurization of the upper-layer space 15*a* in the resist bottle 15 is stopped. The supply of the resist R is thus stopped with the pump chamber 11*c* of the discharge pump 11 filled with the resist R. The supply and filling of the resist R will be described later.

At the timing of t1, the electromagnetic solenoid of the second switching valve 26 is turned on by a fourth command signal from the controller 29, and the second switching valve 26 is switched to the open position. Therefore, the compressed air of the set pressure supplied to the second switching valve 26 flows into the operating chamber 11*a*. As such, the flexible membrane 11*b* presses the pump chamber 11*c* under the pressure of the operating chamber 11*a*, so the pressure of the operating chamber 11*a* becomes the discharge pressure of the resist R filled into the pump chamber 11*c*.

Next, at the timing of t2, which occurs after time T1 set as a hold time has passed from t1, a third control signal from the controller 29 reaches the on level, and the discharge-side closure valve 22 is switched to the open position. Thereby, the discharge tubing 21 is opened, and the resist R is instilled from the tip nozzle of the discharge tubing 21 under the pressure in the pump chamber.

After the instillation of the resist R has begun according to the timing of t2, the third control signal from the controller 29 is brought to the off level and the discharge-side closure valve 22 is switched to the closed position at the timing of t3, which occurs after a predetermined instillation time has passed. The discharge tubing 17 is thus closed, and the instillation of the resist R ends.

Next, the fourth command signal from the controller 29 is brought to the off level and the second switching valve 26 is switched to the closed position at the timing of t4, which occurs after time T2 has passed from t3. The operating chamber 11*a* is thus opened to the atmosphere. The interval of exactly time T2 is set in order to avoid problems, including improper liquid switching at the end of the instillation, that occur when the discharge pressure from the discharge pump 11 rapidly falls as instillation is concluded concurrently with the filling of the resist R.

At the timing of t4, both the second command signal and the fifth command signal from the controller 29 are brought to the on level. The second command signal reaches the on level, the supply-side pump 13 is switched to the open position, and the supply tubing 12 is opened. When the fifth command signal reaches the on level, the first switching valve 17 is switched to the open position. As such, the compressed air of the set pressure supplied to the first switching valve 17 is supplied to the upper-layer space 15*a* in the resist bottle 15. The upper-layer space 15*a* is hermetically sealed, so the supply of the compressed air brings the pressure in the upper-layer space 15*a* from atmospheric pressure to the set pressure of the compressed air, and this pressurizes the resist R. Moreover, the pressure of the upper-layer space 15*a* becomes the supply pressure of the resist R in the supply tubing 12. The supply pressure is positive pressure relative to atmospheric pressure. Additionally, the supply tubing 12 is opened, so the resist R under the supply pressure is supplied to and filled into the pump chamber 11*c* of the discharge pump 11 while dust and other matter are removed by the filter 14. The resist R is filled into the pump chamber 11*c* under pressurized supply in this manner, so no chemical liquid intake mechanism need be provided in the discharge pump 11. The discharge pump 11 can therefore be downsized.

Then, at the timing of t5, the fifth command signal from the controller 29 is brought to the off level, the first switching valve 17 is switched to the closed position, and the supply and filling of the resist R are stopped. Also at the timing of t5, actions similar to those of t1 described earlier are carried out, and these actions (the actions of t1 to t4) are repeated.

A simple explanation is provided about the setting of the supply pressure for supplying and filling the resist R under pressure in the pump chamber 11*c* of the discharge pump 11. As was noted, the supply pressure reflects the compressed air pressure setting set by the pressure control valve 18. Generally, the discharge pump 11 is installed in a position higher than the installation position of the resist bottle 15. When this is the case, a head h (shown in FIG. 1) must be considered when setting the supply pressure. Other necessary considerations are resistance occurring during passage through the filter 14 present midway through the supply tubing 12 and the deforming strength of the flexible membrane 11*b* toward the operating chamber 11*a* side according to the type of discharge pump 11. The supply pressure is set in consideration of these matters.

The following excellent effects are obtained with this preferred embodiment that was explained in detail above.

The resist R under positive pressure is sent under pressure and filled into the pump chamber 11*c* of the discharge pump 11 by supplying compressed air in the upper-layer space 15*a* of the resist bottle 15. This eliminates the conventional need to adopt a configuration in which a spring or other item is used to drive the flexible membrane of the discharge pump 11 toward the operating chamber 11*a* side and cause the resist R to be taken in. Elimination of a motor obviously eliminates the risk of heat damage to the semiconductor wafer 47 and also allows further downsizing of the discharge pump 11.

Downsizing the discharge pump 11 allows the installation space of the discharge pump 11 to be made smaller than previously. In the case of semiconductor manufacturing equipment, as was stated earlier, the discharge pump 11 is positioned near the rotary plate 46 on which the semiconductor wafer 47 is placed so that precision in the amount of the chemical liquid discharged is improved. The maximum level of cleanliness is required within this installation space that includes the rotary plate 46. In consideration of the cost of bringing about clean conditions, such spaces should be made as small as possible, and this configuration greatly contributes to cost reduction in that the installation space can be made smaller. Moreover, the downsizing of the discharge pump 11 allows the discharge pump 11 to be placed more closely to the tip nozzle than is presently possible. As such, when a chemical liquid discharge portion that comprises the tip nozzle and the discharge pump 11 as a pair is provided in plurality, the differences in tubing length from the discharge pump 11 to the tip nozzle and head in each respective chemical liquid discharge portion can be made smaller. Therefore, making the control values of each chemical liquid discharge portion uniform becomes easier, and control of the instillation of the resist R is simplified.

Driving the flexible membrane 11*b* toward the side of the operating chamber 11*a* by evacuating the operating chamber 11*a* to expand the volume of the pump chamber 11*c* and thereby to cause the taking in of the chemical liquid into the pump itself is a possible means for filling the resist R. Such a configuration would eliminate the need for incorporating a spring or other item into the discharge pump 11. Evacuation of the operating chamber 11*a*, however, creates an artificially harsh condition, so a variety of problems are created, including the need for a construction able to tolerate this condition. This embodiment, in which the resist R is supplied to the discharge pump 11 simply by providing another pressurized sending means, is beneficial in that the need for a spring or other item is eliminated and the discharge pump 11 can be downsized according to this very simple configuration.

Causing the taking in of the resist R by evacuating the operating chamber 11*a* subjects the resist R in the pump chamber 11*c* to negative pressure. As such, pressure loss in the filter 14 creates a pressure differential around the filter 14, generating bubbles that damage the semiconductor wafer 47. With regard to this point, this embodiment prevents the generation of bubbles when the resist R passes through the filter 14 because the resist R, with positive pressure, is supplied to the discharge pump 11.

When the fifth command signal of the controller 29 is brought to the on level, the compressed air of the set pressure is supplied to the upper-layer space 15*a* of the resist bottle 15, and the resist R is therefore sent to the discharge pump 11. At this time, the pressure in the upper-layer space 15*a* becomes the supply pressure of the resist R. The supply pressure is positive pressure relative to atmospheric pressure. In this embodiment, the pressure in the upper-layer space 15*a* is brought to the set pressure almost simultaneously with the supply of the compressed air, so the supply pressure can be brought to the set pressure with an excellent response to a command signal. Supplying the compressed gas of the set pressure to the upper-layer space 15*a* allows the supply pressure to be maintained at a constant value, so the control of the supply of resist R is simplified.

The invention is not limited to the description of the above embodiment and can be embodied, for example as follows.

In the above-mentioned embodiment, air was given as an example of a compressed medium supplied to the operating chamber 11*a*, but a gas other than air, such as nitrogen, can also be used.

An example in which the resist R is used as the chemical liquid was discussed, but this was because it was assumed that the object on which the chemical liquid was to be instilled was the semiconductor wafer 47. Therefore, the chemical liquid and the object onto which the chemical liquid is to be instilled can be items other than those.

An example was described in which the discharge pump 11 and the pump chamber 11*c* were divided with the flexible membrane 11*b*, but a pump divided with a bellows can also be used.

Moreover, a pressure sensor can be provided between the discharge pump 11 and the discharge-side closure valve 22 to detect the liquid pressure of the resist R discharged from the discharge pump 11, with signals from the pressure sensor fed back into the electropneumatic regulator 27 so the set pressure of the compressed air can be adjusted. In this case, the electropneumatic regulator 27 adjusts the pressure of the compressed air so the pressure of the operating chamber 11*a* becomes the set pressure in accordance with the degree of difference between the set pressure of the compressed air based on the first command signal from the controller 29 (equal to the discharge pressure) and the pressure signals from the pressure sensor. Thereby, the tension of the flexible membrane 11*b* driven in accordance with pressure changes in the operating chamber 11*c* need not be considered in order to adjust the compressed air to the set pressure (equal to the discharge pressure), and discharge pressure control can be easily accomplished.

In the above embodiment, the resist R is supplied and filled into the pump chamber 11*c* of the discharge pump 11 using pressurized sending in which the upper-layer space 15*a* of the resist bottle 15 is pressurized, but alternatively, a pump that uses a motor or other actuator could be provided on the supply side to supply the resist R. With this composition as well, the effects of the downsizing of the discharge pump 11 and the prevention of bubbles would be realized. Such a pump, however, would be problematic in that the time lag from the receiving of a driving signal to the adjustment of the discharge pressure to the set pressure would be large, and control for maintaining the discharge pressure of the pump (supply pressure) at a constant value would be difficult. From this point of view, the earlier embodiment that accomplishes supply through pressurized sending is preferable.

A configuration could be used in which the first switching valve 17 and the pressure control valve 18 are replaced with a manual valve (one for manually switching the upper-layer space 15*a* to be opened to the atmosphere) and a stationary regulator, with the upper-layer space 15*a* of the resist bottle constantly kept in a pressurized state. Doing so would beneficially reduce the control load in comparison to the earlier embodiment.

The invention claimed is:

1. A chemical liquid supply system comprising:

a discharge pump in which a pump chamber filled with the chemical liquid and an operating chamber are divided by a variable volume member, the variable volume member is driven by supplying an operating gas into the operating chamber to decrease the volume of the pump chamber, and the chemical liquid is discharged according to this change of volume;

an opening-closing-type discharge-side closure valve provided between the discharge pump and a tip nozzle;

a means for switching that switches to either a first state in which the operating gas of a set pressure is supplied to the operating chamber or a second state in which the operating chamber is opened to the atmosphere;

a means for chemical liquid supply that delivers the chemical liquid in a hermetically sealed chemical liquid supply container to the discharge pump;

a gas source connected to the chemical liquid supply container via pressurized tubing;

an opening-closing-type supply-side closure valve provided between the discharge pump and the means for chemical liquid supply; and a means for controlling that controls both of the closure valves and the means for switching so that the supply-side closure valve is switched to a closed position, the discharge-side closure valve is switched to an open position, and the means for switching is switched to the first state when the chemical liquid is to be discharged from the discharge pump; the supply-side closure valve is switched to an open position, the discharge-side closure valve is switched to a closed position, and the means for switching is switched to the second state when the chemical liquid is to be filled into the discharge pump; the timing to switch the discharge-side closure valve to the open position occurs after the means for switching is switched to the first state; and the timing to switch the discharge-side closure valve to the closed position occurs before the means for switching is switched to the second state, wherein another end of a chemical liquid supply tubing, one end of which is connected to the discharge pump, is positioned in the chemical liquid in the chemical liquid supply container, and wherein the means for chemical liquid supply delivers the chemical liquid only by supplying a pressurized gas of a set pressure, greater than atmospheric pressure, from the gas source to a space above the chemical liquid inside the hermetically sealed chemical liquid supply container in a state in which the supply-side closure valve is switched to the open position and the discharge-side closure valve is switched to the closed position.

2. The chemical liquid supply system according to claim 1 wherein the means for chemical liquid supply supplies the pressurized gas of the set pressure to the space above the chemical liquid inside the hermetically sealed chemical liquid supply container by a chemical liquid supply command from the means for controlling.

3. The chemical liquid supply system according to claim 2 wherein a filter is provided between the discharge pump and the chemical liquid supply container.

4. The chemical liquid supply system according to claim 1 wherein the means for chemical liquid supply continuously supplies the pressurized gas of the set pressure to the space above the chemical liquid inside the hermetically sealed chemical liquid supply container.

5. The chemical liquid supply system according to claim 4 wherein a filter is provided between the discharge pump and the chemical liquid supply container.

6. A chemical liquid supply system comprising:

a discharge pump in which a pump chamber filled with the chemical liquid and an operating chamber are divided by a variable volume member, the variable volume member is driven by supplying an operating gas into the operating chamber to decrease the volume of the pump chamber, and the chemical liquid is discharged according to this change of volume;

an opening-closing-type discharge-side closure valve provided between the discharge pump and a tip nozzle;

a means for switching that switches to either a first state in which the operating gas of a set pressure is supplied to the operating chamber or a second state in which the operating chamber is opened to the atmosphere;

a means for chemical liquid supply that delivers the chemical liquid in a hermetically sealed chemical liquid supply container to the discharge pump;

a gas source connected to the chemical liquid supply container via pressurized tubing;

an opening-closing-type supply-side closure valve provided between the discharge pump and the means for chemical liquid supply; and a means for controlling that controls both of the closure valves and the means for switching so that the supply-side closure valve is switched to a closed position, the discharge-side closure valve is switched to an open position, and the means for switching is switched to the first state when the chemical liquid is to be discharged from the discharge pump; the supply-side closure valve is switched to an open position, the discharge-side closure valve is switched to a closed position, and the means for switching is switched to the second state when the chemical liquid is to be filled into the discharge pump; the timing to switch the discharge-side closure valve to the open position occurs after the means for switching is switched to the first state; and the timing to switch the discharge-side closure valve to the closed position occurs before the means for switching is switched to the second state, wherein another end of a chemical liquid supply tubing, one end of which is connected to the discharge pump, is positioned in the chemical liquid in a chemical liquid supply container, the means for chemical liquid supply delivers the chemical liquid only by supplying a pressurized gas of a set pressure, greater than atmospheric pressure, from the gas source to a space above the chemical liquid inside the hermetically sealed chemical liquid supply container in a state in which the supply-side closure valve is switched to the open position and the discharge-side closure valve is switched to the closed position, the filling and discharge of the chemical liquid are alternately performed at the pump chamber, and the means for controlling controls both of the closure valves and the means for switching in order to begin the filling of the chemical liquid that occurs after a predetermined time has passed from the end of the discharge of the chemical liquid.

7. The chemical liquid supply system according to claim 6 wherein the means for chemical liquid supply supplies the pressurized gas of the set pressure to the space above the chemical liquid inside the hermetically sealed chemical liquid supply container by a chemical liquid supply command from the means for controlling.

8. The chemical liquid supply system according to claim 7 wherein a filter is provided between the discharge pump and the chemical liquid supply container.

9. The chemical liquid supply system according to claim 6 wherein the means for chemical liquid supply continuously supplies the pressurized gas of the set pressure to the space above the chemical liquid inside the hermetically sealed chemical liquid supply container.

10. The chemical liquid supply system according to claim 9 wherein a filter is provided between the discharge pump and the chemical liquid supply container.

* * * * *